US005348768A

United States Patent [19]

Shibata et al.

[11] Patent Number: 5,348,768

[45] Date of Patent: Sep. 20, 1994

[54] METHOD OF APPLYING A LIQUID COATING TO A FLEXIBLE WEB

[75] Inventors: Norio Shibata; Akihiro Suzuki, both of Kanagawa, Japan

[73] Assignee: Fuji Photo Film Co., Ltd., Kanagawa, Japan

[21] Appl. No.: 965,523

[22] Filed: Oct. 23, 1992

Related U.S. Application Data

[63] Continuation of Ser. No. 684,724, Apr. 15, 1991, abandoned.

[30] Foreign Application Priority Data

Apr. 20, 1990 [JP] Japan ..... 2-103098

[51] Int. Cl.[5] ..... B05D 3/12

[52] U.S. Cl. ..... 427/356; 427/358; 427/402; 118/410; 118/411

[58] Field of Search ..... 118/410, 411; 427/402, 427/356, 358

[56] References Cited

U.S. PATENT DOCUMENTS

| | | | |
|---|---|---|---|
| 3,526,528 | 9/1970 | Takahashi et al. | 117/34 |
| 3,632,371 | 1/1972 | Mikulka | 117/19 |
| 3,756,195 | 9/1973 | Mercier | 118/126 |
| 4,537,801 | 8/1985 | Takeda | 118/411 |
| 4,681,062 | 7/1987 | Shibata et al. | 118/410 |
| 4,854,262 | 8/1989 | Chino et al. | 118/411 |
| 4,907,530 | 3/1990 | Shibata et al. | 118/410 |
| 4,968,528 | 11/1990 | Tanaka et al. | 427/131 |
| 5,097,792 | 4/1992 | Umemura et al. | 118/411 |

FOREIGN PATENT DOCUMENTS

| | | |
|---|---|---|
| 0329424 | 8/1989 | European Pat. Off. . |
| 4032838 | 5/1991 | Fed. Rep. of Germany . |
| 138036 | 11/1975 | Japan . |
| 7306 | 4/1979 | Japan . |
| 205561 | 11/1983 | Japan . |
| 238179 | 11/1985 | Japan . |
| 139929 | 6/1986 | Japan . |

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

A method of applying at least one liquid to a surface of a carrier includes providing an extrusion-type application head having a slot with an outlet portion and a back edge portion, pushing the outlet portion of the slot toward the surface of the carrier, continuously conveying the carrier along a surface of the back edge portion of the head, and thereafter applying a liquid undercoating in excess to the carrier surface in advance upstream of the head relative to a conveyance direction of the carrier so as to form a liquid undercoating layer on the carrier surface. The liquid is continuously jetted from the slot so that the liquid is applied to the liquid undercoating. As a result, air does not form between the liquid undercoating and the subsequent liquid applied, and the applied liquid has a uniform thickness despite the application speed of the liquid (e.g., conveyance speed of the carrier) being great.

12 Claims, 2 Drawing Sheets

METHOD OF APPLYING A LIQUID COATING TO A FLEXIBLE WEB

This is a continuation of application No. 07/684,724, filed Apr. 15, 1991, now abandoned.

BACKGROUND OF THE INVENTION

The present invention relates to a method of applying a liquid such as a photographic photosensitive liquid, a magnetic liquid and a surface protective liquid to a flexible band-like carrier (which is hereinafter referred to as a web) made of a plastic film, paper, a metal leaf or the like. More particularly, the invention relates to a method of applying a liquid to the surface of a flexible band-like carrier while pushing the outlet portion of an application head toward the surface of the carrier being continuously conveyed.

Various methods have been proposed and practiced, in each of which a liquid is applied to a web being continuously conveyed. One of the methods is practiced with an extrusion-type application device which is used in various fields, as mentioned in Japan Patent Applications (OPI) Nos. 138036/75 and 84771/80 (the term "OPI" as used herein means an "unexamined published application") and Japanese Patent No. 7306/79. However, the extrusion-type application device has a range of proper liquid application which is very narrow. Particularly, when the liquid application speed is greater than or equal to 100 to 150 m/min., it is very difficult for the device to apply the liquid to the web stably and properly so that the applied liquid makes a layer having a thickness of 20μ or less on the web. This is a problem.

As a result of studies, the present inventor found out that this problem occurs because the quantity of air resulting from the web being conveyed and impacting the device's application head increases sharply when the application speed is increased to 100 to 150 m/min. or more. The air impacting the head makes it difficult to apply the liquid to the web in a layer having a uniform thickness.

To solve this problem, a method of application was disclosed in Japan Patent Application (OPI) No. 205561/83. In this method, a liquid which is substantially the same as an applied liquid, which is applied to the surface of a web, is supplied from an upstream (relative to the conveyance direction of the web) slot to the web surface, and the applied liquid is continuously supplied by a prescribed quantity from a downstream slot to the web surface simultaneously with the liquid from the upstream slot. Thus, the upstream slot liquid is between the web surface and the applied liquid, thereby to prevent air from being trapped between the web surface and the applied liquid, and thus performing the application to make a layer having a uniformly flat surface.

Furthermore, as a means to solve the above-mentioned problem, an application device was disclosed in Japan Patent Application (OPI) No. 238179/85. As shown in FIG. 3, the extrusion-type application head 22 of the device has a doctor edge portion having a curved surface 24 so that a pressurized liquid accumulation 27 is formed on the surface when applying a liquid to a web 6 to appropriately control the pressure of the liquid at the outlet portion of a slot 26. This prevents air caused by the movement speed of the web from being trapped between the applied liquid and the web. Thus, the liquid can be applied to the web 6 at a high speed of 300 m/min. by the device so as to form a layer 28 which is not streaked and which has a uniform thickness.

Another method of application was disclosed in Japan Patent Application (OPI) No. 139929/86. In this method, a solvent which is substantially similar to a liquid which is applied to the web surface, is applied to the surface before the liquid is applied, so that the inner surface of the layer of the liquid jetted from an outlet portion of a slot is separated from ambient air by the solvent when the liquid is subsequently applied. Thus, the liquid can be applied to a web moving at a high speed so as to make a thin layer thereon.

However, the above-mentioned method disclosed in Japan Patent Application (OPI) No. 205561/83 has a problem in that when the application speed of the applied liquid is increased dramatically, air is likely to impact between the web surface and the liquid supplied from the upstream slot, so as to vibrate the liquid to affect the applied liquid. Thus, the thickness of the layer of the applied liquid on the web will be non-uniform. Furthermore, the application device disclosed in Japan Patent Application (OPI) No. 238179/85 and described above has a problem in that when the application speed of the liquid is increased to form a layer of smaller thickness, air is trapped in the layer to make it impossible to stably and properly perform the application.

Although the inner surface layer of the applied liquid is separated from the air by the solvent applied to the web prior to liquid application to the web, in the application method disclosed in Japan Patent Application (OPI) No. 139929/86, a problem results in that when the application speed of the liquid is increased and the thickness of the solvent layer is reduced, it is difficult to stably separate the inner surface of the layer of the applied liquid from the air by the solvent, and air is likely to be trapped between the liquid layer and the solvent layer at the back edge portion of an extrusion-type application head.

In view of the foregoing, it is technically difficult to apply a liquid to a web having a conveyance speed of 300 m/min. or more in each of these conventional systems and methods.

SUMMARY OF THE INVENTION

The present invention was designed to solve the above-mentioned problems. Accordingly, it is an object of the present invention to provide an application method in which a liquid can be applied to a web moving at high speeds so as to make a thin layer without streaking.

In the application method, the liquid is applied to the surface of a flexible band-like carrier while pushing the outlet portion of a slot of an extrusion-type application head toward the carrier surface being continuously conveyed while being supported on path rollers. The method includes applying a liquid undercoating in excess to the carrier surface in advance upstream of the application head relative to the conveyance direction of the carrier; conveying the carrier along the surface of the back edge portion of the head, which is curved to have a radius of curvature of 0.5 to 10 mm, so that the relief angle of the carrier to the tangent on the surface of the back edge portion at the incoming point of the carrier thereto is 0° to 15°, the tension of the carrier is 5 to 30 kg/m, and an excess portion of the liquid undercoating is scraped down by the back edge portion of the head to form a liquid undercoating layer; and continuously pushing out the liquid from the slot so as to be applied to the liquid undercoating layer.

BRIEF DESCRIPTION OF THE DRAWINGS

The above-mentioned and other objects, features, and advantages of the present invention will be apparent from the description herein and the drawings attached hereto wherein.

DETAILED DESCRIPTION OF THE PREFERRED EMBODIMENTS

Figure 1:
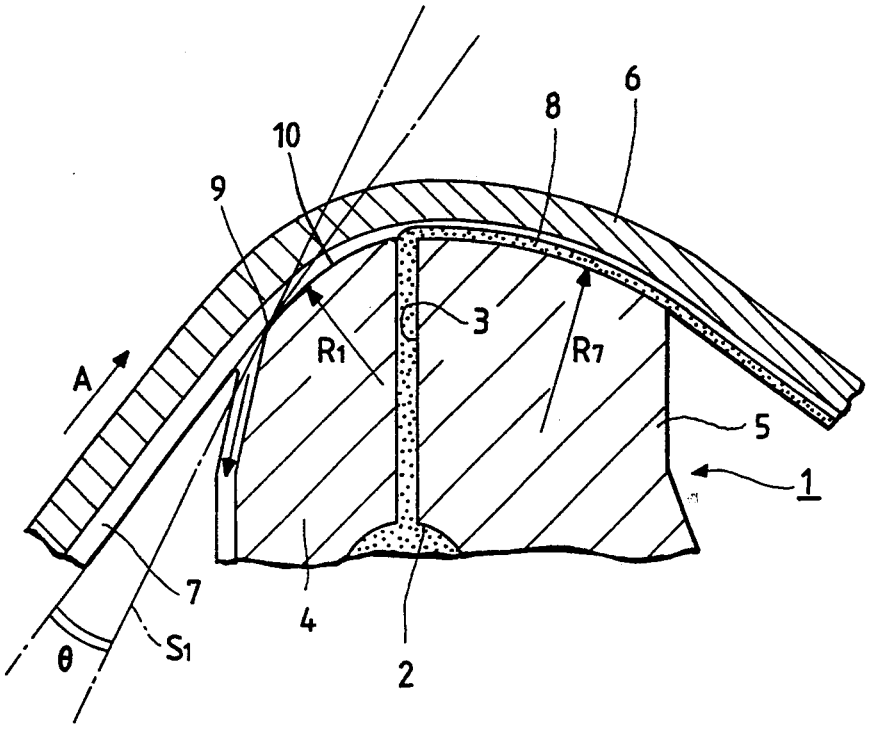
FIG. 1 is a sectional view of an extrusion-type application head for practicing an application method which is an embodiment of the present invention, the application head being pushed against a carrier.

Referring to FIG. 1, an extrusion-type application head 1 of an application device is positioned so as to apply a liquid 8 to a web 6. The major part of the application device includes a liquid feed line (not shown in the drawings), a pocket 2, a slot 3, a back edge portion 4, and a doctor edge portion 5.

The liquid feed line includes a constant-quantity liquid feed-pump provided outside the body of the application head 1 so as to continuously feed the liquid 8 at a constant flow rate, and a pipe for connecting the pump to the pocket 2 extending through the body of the head along the width direction of the web 6.

The pocket 2 is a liquid reservoir and extends along the width direction of the web 6 so that the pocket has a cross-section nearly circular for its entire length. The effective length of the pocket 2 is set to be equal to or slightly larger than the width of the liquid-applied area of the web 6.

The slot 3 is a relatively narrow passage and extends through the body of the application head 1 from not only the pocket 2 toward the web 6, but also along the width direction of the web as well as the pocket so that the width of the outlet portion of the slot is generally set at 0.03 to 2 mm. The length of the outlet portion of the slot 3 is set to be nearly equal to the width of the liquid-applied area of the web 6. The dimensions of the slot 3 are appropriately determined according to various factors such as the composition, physical properties, supply flow rate and supply pressure of the liquid 8. Particularly, the slot's dimensions are formed so that the liquid 8 flows in a laminar manner through the slot 3 from the pocket 2 toward the web 6 while having a uniform flow rate distribution and pressure distribution along the web's width.

The doctor edge portion 5 is located downstream of the outlet portion of the slot 3 with regard to the conveyance direction of the web 6. The back edge portion 4 is located upstream of the outlet portion of the slot 3 with regard to the conveyance direction. The surface 10 of the back edge portion 4, which faces the web 6, is circularly curved along the web's conveyance direction A according to the present invention so that the radius $R_1$ of curvature of the surface is 0.5 to 10 mm.

Figure 2:
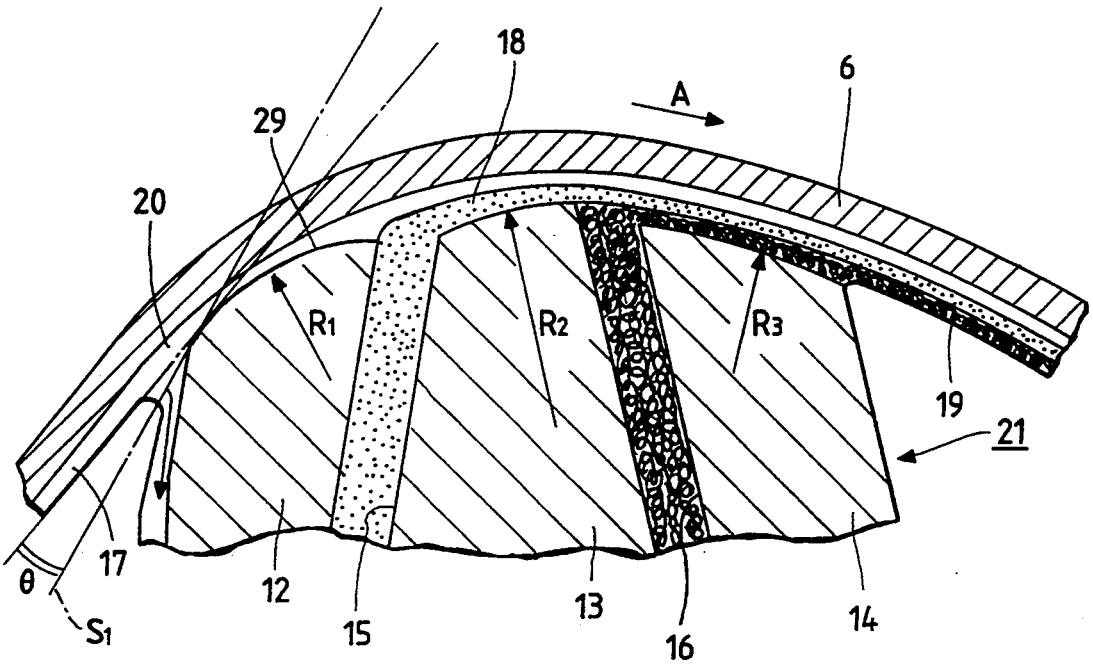
FIG. 2 is a sectional view of an extrusion-type application head for practicing a double-layer simultaneous application method which is a second embodiment of the present invention, the application head being pushed against a carrier.

The web 6 is supported on conveyance guide means such as path rollers so that the tension of the web between the conveyance guide means is 5 to 30 kg/m, and the relief angle $\theta$ of the web to the tangent $S_1$ the point of tangency being located on a surface of the back edge portion 4 at the point of the incoming web to the surface is 0° to 15°. In particular, the point of tangency lies at the intersection of the front planar surface of the back edge portion and the curved, upper portion thereof, as shown in FIGS. 1 and 2. The web is placed near the back edge portion 4 and the doctor edge portion 5 and curved substantially parallel with the web-facing surfaces of the edge portions, as shown in FIG. 1. Upon supplying the liquid 8 at a desired flow rate to the application head 1 through the liquid feed line, the liquid flows through the pocket 2 and the slot 3. The back edge portion 4 and the doctor edge portion 5 serve to retain the liquid, and the liquid is pushed out from the outlet portion of the slot 3 while having uniform flow rate distribution and pressure distribution along the width of the web 6.

With the method, a solvent 7, which is a liquid undercoating and is similar to the liquid 8 or is a solvent mutually soluble with the liquid 8, is applied in excess to the surface of the web 6 by an application machine (not shown in the drawings), such as a roller application machine, before the liquid 8 is applied to the web surface by the application head 1. Thus, the liquid 8 is applied to the web surface by the head 1 with the solvent 7 already thereon. The excess portion of the solvent 7 already applied to the surface of the web 6 is scraped down by the upstream edge 9 of the surface 10 of the back edge portion 4 so that the excess portion flows down the side surface of the application head 1.

The solvent 7 thereafter remaining on the web's surface separates the inner surface of the layer of the applied liquid 8 and the web-facing surface 10 of the back edge portion 4 from air throughout the liquid application. Even if the application speed of the liquid 8 to the web 6 is increased and the thickness of the layer of the applied solvent 7 on the web is reduced, the inner curved surface, of the layer of the applied liquid 8 is stably separated from the air by the solvent 7. Thus, it is unlikely that air accompanying the layer of the applied solvent is present between the web-facing surface 10 of the back edge portion 4 and the applied solvent. Additionally, any extraneous substance or the like clinging to the surface of the web 7 is scraped off by the upstream edge 9 of the surface 10 before the application of the liquid 8 to the web. Thus, the layer of the applied liquid 8 on the web 6 is not streaked, and therefore is uniform.

Thus, the behavior of the web 6 is kept stable even if it is conveyed at speeds much greater than those used in the conventional methods and systems. For example, even if the web 6 is conveyed at 600 m/min. or more, air accompanying the web (e.g., caused by the conveyance of the web) is prevented from being mingled with the layer of the applied liquid 8, to make the application of the liquid extremely uniform.

Referring to FIG. 2, a second embodiment of the present invention is shown in which an extrusion-type application head 21 is used for practicing a double-layer simultaneous application method. In FIG. 2, two liquids 18, 19 are applied to a web 6 as the application head 21 is positioned to the web. The structure of the head 21 allows simultaneous application of the liquids 18 and 19 to the web to make two layers thereon.

For such an application, the head 21 includes pockets (not shown in FIG. 2) provided therein to accumulate the liquids 18, 19, slots 15 and 16 also provided therein and communicating with the pockets, a back edge portion 12 located upstream of the slot 15 relative to the conveyance direction of the web 6, a first doctor edge portion 13 located upstream of the slot 16 with regard to the conveyance direction, and a second doctor edge portion 14 located downstream of the slot 16 with regard to the conveyance direction. The surface 29 of the back edge portion 12 which faces the web 6 is circularly curved similarly to the above-mentioned back edge portion 4 so that the radius $R_1$ of curvature is 0.5 to 10 mm. The carrier-facing surface of each of the first and second doctor edge portions 13, 14 is not confined to being a particular surface, but may be a curved surface, a flat surface or a combination of flat surfaces.

The web 6 moving in conveyance direction A is supported on conveyance guide means such as path rollers so that the web tension is 5 to 30 kg/m, the relief angle $\theta$ of the web to the tangent $S_1$ on the carrier-facing surface 29 of the back edge portion 12 at a point of the incoming web to the surface 29 is 0° to 15° and the web is placed near the back edge portion and the first and second doctor edge portions 13, 14 and curved to be substantially parallel with the carrier-facing surfaces of the edge portions, as shown in FIG. 2. Upon supplying liquids 18, 19 at desired flow rates to the application head 21 through a liquid feed line, the liquids are pushed out from the outlet portions of the slots 15, 16 while having uniform flow rate distributions and pressure distributions along the width of the web 6.

With the method, a solvent 17, which is a liquid undercoating and which is substantially similar to the liquid 18 or is a solvent mutually soluble with liquid 18, is applied in excess to the surface of the web 6 by an application machine (not shown in FIG. 2), such as a roller application machine before the simultaneous application of the liquids 18 and 19 to the web surface by the application head 21. The liquids 18, 19 are simultaneously applied to the web surface as the surface remains wet with the solvent 17. The excess portion of the solvent 17 already applied to the web's surface is scraped down by the upstream edge 20 of the surface 29 of the back edge portion 12 so that the excess portion flows down the side surface of the application head 21.

The solvent 17 thereafter remaining on the web's surface separates the inner surface of the layer of the applied liquid 18 and the surface 29 of the back edge portion 12 from air during the application of the liquids 18, 19. Even if the application speed of the liquids 18, and 19 is increased (e.g., increasing the conveyance speed of the web in conveyance direction A) and the layer thickness of the applied solvent 17 on the web 6 is reduced, the applied liquid layer's inner surface is stably separated from air by the solvent 17, thereby making it unlikely that air accompanying the layer of the applied solvent will be trapped between the surface 29 of the back edge portion 12 and the solvent.

Additionally, an extraneous substance or the like clinging to the web surface will be caught by the upstream edge 20 of the surface 29 of the back edge portion 12 before the liquids 18, 19 are applied. Thus, the layers of the applied liquids 18, 19 on the web 6 are not streaked, and therefore are uniform.

Thus, with the present invention, the web 6 is stable even when conveyed at speeds much higher than those previously employed in the conventional systems and methods. For example, even if the web 6 is conveyed at 600 m/min. or more, air accompanying the web is prevented from being mingled with the applied liquids 18, 19, thereby making the double-layer simultaneous application of the liquids extremely uniform and efficient.

The application heads 1 and 21 are not confined to having the above-described forms, but may have other various forms.

The solvents 7 and 17 are required to have a good wetting property with the webs 6 and be mutually soluble with the solvents of the applied liquids 8, 18 and 19. Preferably, the solvents 7 and 17 are identical or substantially similar in composition to the solvents of the applied liquids 8, 18 and 19. A solution containing a binder may be used instead of the solvents 7 and 17. The viscosity of the solution is required to be relatively low, preferably 5 cp or less.

Thus, in an application method according to the present invention, a liquid is applied to the surface of a flexible band-like carrier while the carrier is supported on path rollers and is continuously conveyed and the outlet portion of a slot of an extrusion-type application head is pushed toward the surface of the web. A liquid undercoating (e.g., solvent) is applied in excess to the carrier surface in advance upstream of the application head relative to the conveyance direction A of the web. The carrier is conveyed so that the relief angle thereof to the tangent on the carrier-facing surface (which is circularly curved to have a 0.5 to 10 mm curvature radius) of the back edge portion of the application head at the point of the incoming carrier to the surface is 0° to 15° the carrier tension is 5 to 30 kg/m, and the excess portion of the liquid undercoating is scraped by the back edge portion to make a liquid undercoating layer on the carrier surface. The applied liquid is continuously jetted from the slot so that the liquid is applied to the liquid undercoating layer on the carrier surface.

The liquid undercoating applied to the web in advance separates the subsequent applied liquid layer's inner surface and the surface of the back edge portion from air throughout the application of the liquid. Even if the application speed of the subsequently applied liquid is increased (e.g., the web's conveyance speed is increased) and the thickness of the liquid undercoating is reduced, the inner surface of the layer of the subsequently applied liquid is stably separated from the air by the liquid undercoating layer so that it is unlikely that air accompanying the movement of the liquid undercoating layer will be trapped between the surface of the back edge portion and the liquid undercoating.

Additionally, any extraneous substance or the like which is clinging to the carrier surface is scraped off by the upstream edge of the back edge portion's surface. Thus, the layer of the subsequently applied liquid applied to the carrier surface is not streaked, and therefore is uniform and has high quality. Thus, the subsequently applied liquid can be applied to the carrier moving at a very high speed so as to make a thin layer without forming streaks.

EXAMPLES

Hereinafter, the effect of the present invention is clarified by describing actual examples 1–5 of the embodiments thereof and comparative examples 1–3. The present invention is not confined to these actual examples.

Actual Example 1

Substances shown in Table 1 were placed in a ball mill so that the substances were well mixed and dispersed together. 30 parts by weight of an epoxy resin of 500 in epoxy equivalent were added to the mixture and uniformly mixed and dispersed therewith so that a magnetic liquid A was produced.

TABLE 1

| | |
|---|---|
| $\gamma$-$Fe_2O_3$ powder (acicular grains of 0.5$\mu$ in mean diameter along major axis and 320 oersted in coercive force) | 300 parts by weight |
| Copolymer of vinyl chloride and vinyl acetate (87:13 in copolymerization ratio and 400 in polymerization degree) | 30 parts by weight |
| Electroconductive carbon | 20 parts by weight |
| Polyamide resin (300 in amine value) | 15 parts by weight |
| Lecithin | 6 parts by weight |
| Silicone oil (dimethyl polysiloxane) | 3 parts by weight |
| Xylol | 300 parts by weight |
| Methyl isobutyl ketone | 300 parts by weight |
| N-butanol | 100 parts by weight |

Figure 4:
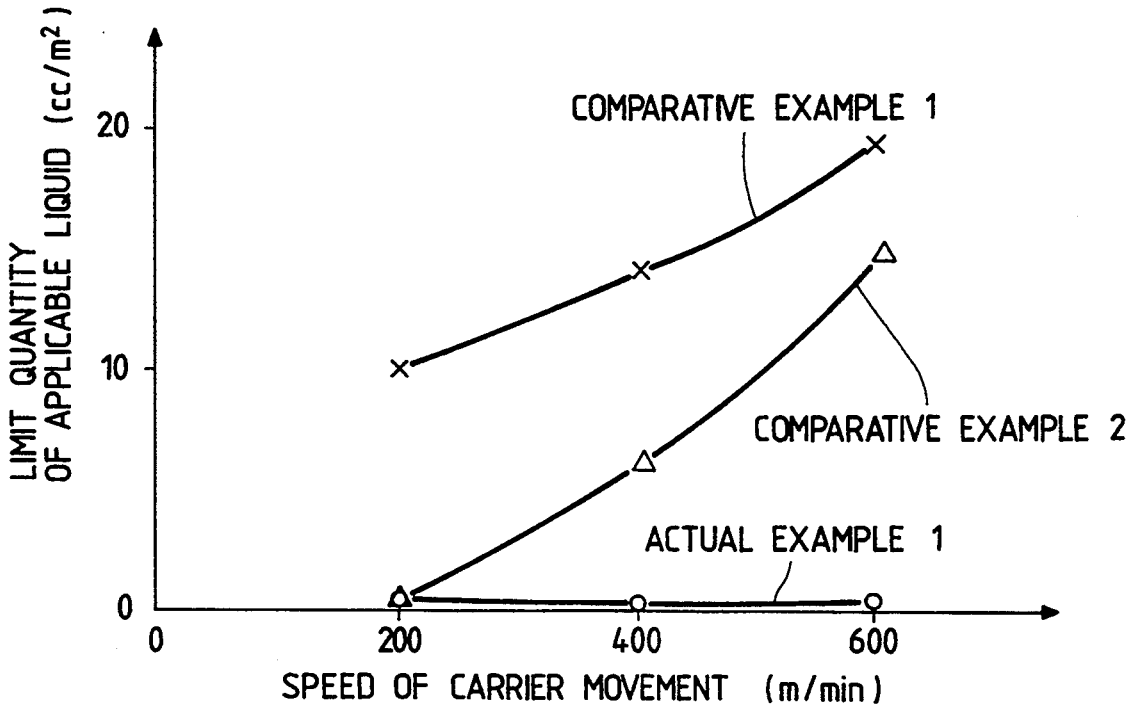
FIG. 4 is a graph showing the relationship between the speed of application and the limit quantity of a liquid applicable without the affect of air attendant to the carrier's movement.

When the equilibrium viscosity of the magnetic liquid A was measured by the Shimadzu rheometer RM-1 manufactured by Shimadzu Corporation, the reading of the rheometer was 8 poise at a shearing speed of 10 per second and 1 poise at a shearing speed of 500 per second. The magnetic liquid A was applied to a carrier having hereinafter-described factors by employing the above-mentioned application method and the above-mentioned application device described in detail hereinafter. The limit quantity of the magnetic liquid A able to be applied without the involvement or influence of the air accompanying the carrier was measured at each of the conveyance speeds of the carrier. The results of the measurement are shown in FIG. 4.

The carrier was a polyethylene terephthalate film having a thickness of 20$\mu$ and a width of 300 mm. The tension of the carrier was set at 5 kg for the entire width thereof. The carrier was conveyed at speeds of 200 m/min., 400 m/min. and 600 m/min. After 50 cc/m$^2$ of xylol was applied to the carrier by a roller application machine, the magnetic liquid A was applied to the carrier by the extrusion-type application head 1 shown in FIG. 1 and positioned to scrape part of the xylol to reduce an applied quantity thereof to 5 cc/m$^2$. The radius $R_1$ of curvature of the carrier-facing surface of the back edge portion of the head 1, the length of the surface along the conveyance direction of the carrier, the radius $R_7$ of curvature of the carrier-facing surface of the doctor edge portion of the head, and the length of the latter surface along the conveyance direction were 1.0 mm, 0.4 mm, 5.0 mm and 2.5 mm, respectively. The width of the outlet portion of the slot of the head 1 was 0.6 mm. The relief angle $\theta$ of the carrier to the tangent $S_1$ on the carrier-facing surface of the back edge portion of the head 1 at the point of the incoming carrier to the surface was set at 0° to 10° so that the applied quantity of the xylol remaining on the carrier after being partly scraped was 5 cc/m$^2$ at each of the conveyance speeds of the carrier.

Comparative Example 1

Figure 3:
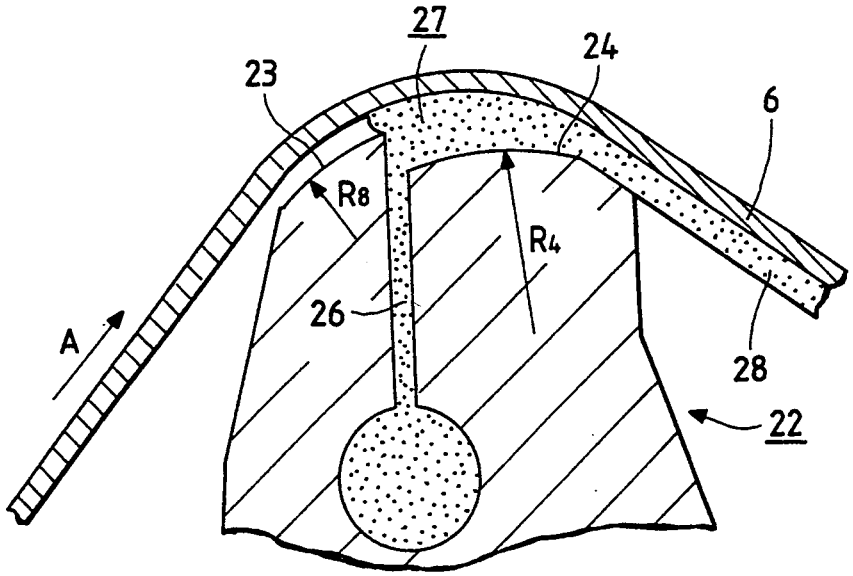
FIG. 3 PRIOR ART
FIG. 3 is a sectional view of an extrusion-type application head for practicing a conventional application method, and shows the head in a state of being pushed against a carrier.

The extrusion-type application head 22, disclosed in Japan Patent Application (OPI) No. 238179/85 and shown in FIG. 3, was used so that the same magnetic liquid A was applied to the same carrier as the Actual Example 1, but without applying any solvent to the carrier in advance. The radius $R_8$ of curvature of the carrier-facing surface 23 of the back edge portion of the head 22, the length of the surface along the conveyance direction of the carrier, the radius $R_4$ of curvature of the carrier-facing surface 24 of the doctor edge portion of the head, the length of the latter surface along the conveyance direction, and the width of the outlet portion of the slot 26 of the head were 20 mm, 10 mm, 2.0 mm, 0.8 mm, and 0.6 mm, respectively. The other factors for the application were the same as the Actual Example 1.

Comparative Example 2

An extrusion-type application head, constructed basically the same as that of the application head 22 disclosed in Japan Patent Application (OPI) No. 238179/85 and shown in FIG. 3, was used so that 5 cc/m$^2$ of xylol was applied to the same carrier as the Actual Example 1. After that, the same magnetic liquid A was applied to the carrier as in the Actual Example 1 by the application head 22. The other factors for the application of the magnetic liquid A by the application head 22 were the same as those for the Actual Example 1. The radius of curvature of the carrier-facing surface of the back edge portion of the application head for the application of the xylol, the length of the surface along the application of the xylol, the length of the surface along the conveyance direction of the carrier, the radius of the curvature of the carrier-facing surface of the doctor edge portion of the head, the length of the latter surface along the conveyance direction, and the width of the outlet portion of the head's slot were 15 mm, 5 mm, 4 mm, 2 mm, and 0.6 mm, respectively.

In each of the Actual Example 1 and the Comparative Examples 1 and 2, the magnetic liquid A was applied by a quantity of 22 cc/m$^2$ and a length of 8,000 m to the carrier. The number of streaks on the layer of the applied magnetic liquid A on the carrier was measured. Table 2 shows the results of the measurement.

TABLE 2

| | Number of streaks |
|---|---|
| Actual example 1 | 0 |
| Comparative example 1 | 11 |
| Comparative example 2 | 10 |

It is understood from FIG. 4 and Table 2 that with the application method according to the present invention, the quantity of the magnetic liquid A able to be applied without the affects of the air accompanying the carrier's movement was increased dramatically at an application speed of 200 m/min. or more, and the number of the steaks on the applied magnetic liquid layer on the carrier was decreased because of the upstream edge of the back edge portion of the application head removing extraneous substances.

Actual Example 2

Substances shown in Table 3 were placed in a ball mill so that the substances were well mixed and dispersed together. 30 parts by weight of an epoxy resin of 500 in epoxy equivalent were added to the mixture and uniformly mixed and dispersed therewith so that a magnetic liquid B was produced.

TABLE 3

| | |
|---|---|
| $\gamma$-$Fe_2O_3$ powder (acicular grains of 0.3$\mu$ in mean diameter along major axis and 540 oersted in coercive force) | 300 parts by weight |
| Copolymer of vinyl chloride and vinyl acetate (87:13 in copolymerization ratio and 400 in polymerization degree) | 30 parts by weight |
| Electroconductive carbon | 10 parts by weight |
| Polyamide resin (300 in amine value) | 15 parts by weight |
| Lecithin | 6 parts by weight |
| Silicone oil (dimethyl polysiloxane) | 3 parts by weight |
| Xylol | 300 parts by weight |
| Methyl isobutyl ketone | 300 parts by weight |
| N-butanol | 100 parts by weight |

When the equilibrium viscosity of the magnetic liquid B was measured by the Shimadzu rheometer RM-1 manufactured by Shimadzu Corporation, the reading of the rheometer was 11 poises at a shearing speed of 10 per second and 1.6 poises at a shearing speed of 500 per second. The magnetic liquids A and B were simultaneously applied to a carrier with hereinafter-described factors through the use of the above-mentioned application method and the above-mentioned application device described in detail hereinafter, so that the liquid A formed a first, lower layer and the other liquid B formed a second, upper layer. The quantity of the magnetic liquid B able to be applied to form the upper layer at a minimum thickness thereof at each of conveyance speeds of the carrier was measured. FIG. 4 shows the results of the measurement. The carrier was a polyethylene terephthalate film having a thickness of 20$\mu$ and a width of 300 mm. The carrier tension was 5 kg for the entire width thereof. The carrier was conveyed at speeds of 200 m/min., 400 m/min. and 600 m/min. After 50 cc/$m^2$ of xylol was applied to the carrier by a roller application machine, the magnetic liquids A and B were simultaneously applied to the carrier by the extrusion-type application head 21 shown in FIG. 2 and positioned to scrape a part of the xylol to reduce the applied quantity of the xylol to 5 cc/$m^2$. The radius $R_1$ of curvature of the carrier-facing surface of the back edge portion of the head 21, the length of the surface along the conveyance direction of the carrier, the radius $R_2$ of curvature of the carrier-facing surface of the first doctor edge portion of the head, the length of the latter surface along the conveyance direction, the radius $R_3$ of curvature of the carrier-facing surface of the second doctor edge portion of the head, the length of the latter surface along the direction, and the width of the outlet portion of each slot of the head were 1.0 mm, 0.4 mm, 1.5 mm, 0.6 mm, 4.0 mm, 2.0 mm, and 0.6 mm, respectively. The relief angle $\theta$ of the carrier to the tangent $S_1$ on the carrier-facing surface of the back edge portion at the point of the incoming carrier to the surface was set at 0° to 10° so that the applied quantity of the xylol remaining on the carrier after being partly scraped was 5 cc/$m^2$ at each of the conveyance speeds of the carrier.

Comparative Example 3

The same magnetic liquids A and B were simultaneously applied to the same carrier by the same application head 21 as that in the Actual Example 2. The relief angle $\theta$ of the carrier to the tangent $S_1$ on the carrier-facing surface of the back edge portion of the head 21 at the point of the incoming carrier to the surface was set at 0 degrees. The other factors for the application were the same as those in the Actual example 2.

TABLE 4

| Conveyance speed of carrier (m/min.) | Applied quantity limit for upper layer (cc/$m^2$) Actual Example 2 | Comparative Example 3 |
|---|---|---|
| 200 | 0.4 | 0.6 |
| 400 | 0.8 | 1.2 |
| 600 | 1.1 | 1.8 |

It is understood from Table 4 that, in the double-layer simultaneous application method according to the present invention, the effects of air (and the mingling thereof) in the lower layer of the applied magnetic liquid A by the carrier accompanied by the air are suppressed to reduce the deterioration of the application of the lower-layer magnetic liquid B, which is caused by the disturbance of the application of the former liquid (e.g., magnetic liquid A).

Actual Example 3

The magnetic liquid A was applied to a carrier with factors and parameters described hereinafter. The surface of the magnetic liquid (A) layer applied to the carrier with various combinations of the factors was observed. Table 5 shows the results of the observation.

The carrier was a polyethylene terephthalate film having a thickness of 20$\mu$ and a width of 300 mm. The carrier was conveyed at speeds of 200 m/min., 400 m/min. and 600 m/min. After 50 cc/$m^2$ of xylol was applied to the carrier by a roller application machine, the magnetic liquid A was applied to the carrier by the extrusion-type application head 1 shown in FIG. 1. The tension of the carrier was set at 5 to 30 kg/m. The radius $R_1$ of curvature of the carrier-facing surface of the back edge portion of the application head was set at 0.5 to 10 mm. The relief angle $\theta$ of the carrier to the tangent $S_1$ on the carrier-facing surface of the back edge portion at the point of the incoming carrier to the surface was set at −5°, 0°, 5°, 10°, 15°, and 20°.

TABLE 5

| Relief angle $\theta$ of carrier at point of incoming thereof | Conveyance speed (m/min.) of carrier 200 | 400 | 600 |
|---|---|---|---|
| −5° | Δ | X | X |
| 0° | ○ | ○ | ○ |
| 5° | ○ | ○ | ○ |
| 10° | ○ | ○ | ○ |
| 15° | ○ | ○ | Δ |
| 20° | Δ | Δ | X |

Note:
The sign ○ means that the application was good.
The sign Δ means that the application was sometimes good but bad at other times.
The sign X means that a scratch was made in the surface of the carrier when the releif angle $\theta$ thereof at the point of incoming thereof was negative, and a streak was regularly made on the layer of the applied liquid when the relief angle was positive.

Actual example 4

After 50 cc/$m_2$ of xylol was applied to the same carrier by the same roller application machine as the Actual Example 3, the same magnetic liquid A was applied to the carrier by the same extrusion-type application head 1 as the Actual Example 3. The relief angle $\theta$ of the carrier to the tangent $S_1$ on the carrier-facing surface of the back edge portion of the application head at the point of the incoming carrier to the surface was 0° to 15°. The radius $R_1$ of curvature of the carrier-facing surface of the back edge portion is 0.5 to 10 mm. The tension of the carrier was set at 2.5 kg/m, 5 kg/m, 10 kg/m, 15 kg/m, 20 kg/m, 25 kg/m, 30 kg/m, and 35 kg/m. The other factors pertinent to the application of the magnetic liquid A were the same as those in the Actual Example 3. The surface of the layer of the magnetic liquid A applied to the carrier with each of various combinations of the factors was observed.

TABLE 6

| Tension (kg/m) of carrier | Conveyance speed (m/min.) of carrier | | |
|---|---|---|---|
| | 200 | 400 | 600 |
| 2.5 | X | X | X |
| 5 | ○ | Δ | Δ |
| 10 | ○ | ○ | ○ |
| 15 | ○ | ○ | ○ |
| 20 | ○ | ○ | Δ |
| 25 | ○ | ○ | ○ |
| 30 | ○ | ○ | ○ |
| 35 | X | Δ | ○ |

Note:
The sign ○ means that the application was good.
The sign Δ means that the application was sometimes good but bad at other times.
The sign X means that the application was nonuniform due to the nonuniformity of pushing of the carrier along the width thereof when the tension of the carrier was low, and a scratch was made in the carrier surface of when the tension thereof was high.

Actual Example 5

After 50 cc/m$^2$ of xylol was applied to the same carrier by the same roller application machine as that in Actual Example 3, the same magnetic liquid A was applied to the carrier by the same extrusion-type application head 1 as that used in Actual Example 3. The relief angle $\theta$ of the carrier to the tangent $S_1$ on the carrier-facing surface of the back edge portion of the application head at the point of the incoming carrier to the surface was 0° to 15°. The tension of the carrier was 5 to 30 kg/m. The radius $R_1$ of curvature of the carrier-facing surface of the back edge portion was set at 0.3 mm, 0.5 mm, 1.0 mm, 5.0 mm, 7.0 mm, 10.0 mm and 15.0 mm. The other factors for the application of the magnetic liquid A were the same as that for Actual Example 3. The surface of the layer of the magnetic liquid A applied tot he carrier with each of various combinations of the factors was observed. Table 7 shows the results of the observation.

TABLE 7

| Radius $R_1$ (mm) of curvature | Conveyance speed (m/min.) of carrier | | |
|---|---|---|---|
| | 200 | 400 | 600 |
| 0.3 | X | Δ | Δ |
| 0.5 | ○ | ○ | ○ |
| 1.0 | ○ | ○ | ○ |
| 5.0 | ○ | ○ | ○ |
| 7.0 | ○ | ○ | ○ |
| 10.0 | ○ | ○ | ○ |
| 15.0 | Δ | Δ | X |

Note:
The sign ○ means that the application was good.
The sign Δ means that the application was sometimes good but bad at other times.
The sign X means that a scratch was made in the carrier surface when the radius of curvature of the surface of the back edge portion was small, and the application was nonuniform due to the nonuniformity of pushing of the carrier along the width thereof when the radius of curvature was large.

From Tables 5, 6 and 7, it is understood that, with the application method according to the present invention, the layer is preferably formed by the applied liquid on the carrier while the carrier is conveyed along the surface of the back edge portion of the application head. The back edge portion preferably is curved to have a radius of curvature of 0.5 to 10 mm, so as to set the relief angle $\theta$ at 0° to 15° and the tension of the carrier at 5 to 30 kg/m and so that the excess portion of the other liquid (e.g., liquid undercoating) applied to the carrier in advance is scraped.

While a preferred embodiment of this invention has been described above, it will be obvious to those skilled in the art that various changes and modifications may be made therein without departing from the invention, and that thus the appended claims are intended to cover all such changes and modifications which fall within the true spirit and scope of the invention.

We claim:

1. A method of applying a liquid (8) to a surface of a flexible carrier (6), said method comprising the steps of:

providing an extrusion application head (1) comprising a back edge portion (4) and a doctor edge portion (5), said portions (4 and 5) being separated by a slot (3) including an outlet portion, said back edge portion (4) including a front, angled, planar surface adjacent to a curved, upper surface so as to form a scraping edge (9), said doctor edge portion (5) including an application surface;

providing said curved, upper surface of said back edge portion of said extrusion application head with a radius of curvature of 0.5 to 10 mm, so that a relief angle of said carrier to a tangent on said curved, upper surface of said back edge portion at said scraping edge is 0° to 15°;

pushing said extrusion application head toward said surface of said carrier such that said curved, upper surface of said back edge portion (4), including said scraping edge (9), said application surface and said slot outlet portion are urged against said carrier and enveloped by said carrier to deflect said carrier, said carrier having a tension of 5 to 30 kg/m;

continuously conveying said carrier;

applying a liquid undercoating (17) in excess to said surface of said carrier upstream and in advance of said extrusion application head relative to a conveyance direction (A) of said carrier so as to form a liquid undercoating layer on said surface of said carrier;

scraping the excess liquid undercoating from said carrier by conveying said carrier along a surface of said back edge portion of said head such that said scraping edge (9) scrapes off the excess undercoating liquid to prevent air from entering between said application surface and said carrier;

removing said excess undercoating, said excess undercoating flowing down said front, angled, planar surface of said back edge portion; and continuously jetting out said liquid from said slot so that said liquid is applied over said liquid undercoating layer.

2. A method of applying a liquid to a surface of a carrier as recited in claim 1, further comprising a step of providing path roller means for supporting said carrier being continuously conveyed.

3. A method of applying a liquid to a surface of a carrier as recited in claim 1, wherein said liquid undercoating comprises a solvent.

4. A method of applying a liquid to a surface of a carrier as recited in claim 1, wherein said liquid undercoating comprises a binder.

5. A method of applying a liquid to a surface of a carrier as recited in claim 1, wherein said liquid undercoating comprises a material substantially similar to that of said liquid.

6. A method of applying a liquid to a surface of a carrier as recited in claim 1, wherein said liquid undercoating comprises a solvent mutually soluble with that of said liquid.

7. A method of simultaneously applying a plurality of liquids (18 and 19) to a surface of a flexible carrier (6), said method comprising the steps of:

providing an extrusion application head (1) including two or more doctor edge portions, each of said doctor edge portions being separated by a slot (15 and 16) having an outlet portion, said doctor edge portions each including an application surface, said extrusion head also including a back edge portion (12) including a front, angled, planar surface adjacent to a curved, upper surface so as to form a scraping edge (9);

providing said curved, upper surface of said back edge portion of said extrusion application head with a radius of curvature of 0.5 to 10 mm, so that a relief angle of said carrier to a tangent on said curved, upper surface of said back edge portion at said scraping edge is 0° to 15°;

pushing said extrusion application head toward said surface of said carrier such that said curved, upper surface of said back edge portion (12), including said scraping edge (9), said application surface and said slot outlet portions are urged against and enveloped by said carrier to deflect said carrier, said carrier having a tension of 5 to 30 kg/m;

continuously conveying said carrier;

applying a liquid undercoating (17) in excess to said surface upstream and in advance of said extrusion application head relative to a conveyance direction (A) of said carrier so as to form a liquid undercoating layer on said surface of said carrier;

scraping the excess liquid undercoating from said carrier by conveying said carrier along a surface of said back edge portion of said head such that said scraping edge (9) scrapes off the excess undercoating liquid to prevent air from entering between said application surface and said carrier;

removing said excess undercoating, said excess undercoating flowing down said front, angled, planar surface of said back edge portion; and continuously jetting out said plurality of liquids from said slots so that said plurality of liquids are simultaneously applied to said liquid undercoating layer to form mutually-overlaid layers of said liquids on said surface of said carrier.

8. A method of simultaneously applying a plurality of liquids to a surface of a carrier as defined in claim 7, further comprising a step of providing path roller means for supporting said carrier being continuously conveyed.

9. A method of simultaneously applying a plurality of liquids to a surface of a carrier as defined in claim 7, wherein said liquid undercoating comprises a solvent.

10. A method of simultaneously applying a plurality of liquids to a surface of a carrier as defined in claim 7, wherein said liquid undercoating comprises a binder.

11. A method of simultaneously applying a plurality of liquids to a surface of a carrier as defined in claim 7, wherein said liquid undercoating comprises a material substantially similar to that of said liquid.

12. A method of simultaneously applying a plurality of liquids to a surface of a carrier as defined in claim 7, wherein said liquid undercoating comprises a solvent mutually soluble with that of said liquid.

* * * * *